US008071897B2

(12) United States Patent
Chiu

(10) Patent No.: US 8,071,897 B2
(45) Date of Patent: Dec. 6, 2011

(54) KEY STRUCTURE

(75) Inventor: Yen-Nan Chiu, Tu-Cheng (TW)

(73) Assignee: Chi Mei Communication Systems, Inc., Tu-Cheng, New Taipei (TW)

( * ) Notice: Subject to any disclaimer, the term of this patent is extended or adjusted under 35 U.S.C. 154(b) by 320 days.

(21) Appl. No.: 12/471,550

(22) Filed: May 26, 2009

(65) Prior Publication Data

US 2009/0321237 A1 Dec. 31, 2009

(30) Foreign Application Priority Data

Jun. 27, 2008 (CN) ..... 2008 1 0302410

(51) Int. Cl.
*H01H 9/26* (2006.01)

(52) U.S. Cl. ..... 200/5 A; 200/512

(58) Field of Classification Search ..... 200/341, 200/5 A, 1 B, 511–512, 516, 518, 520
See application file for complete search history.

(56) References Cited

U.S. PATENT DOCUMENTS 4,659,881 A * 4/1987 Dowe ..... 200/5 R
5,510,584 A * 4/1996 Norris ..... 200/5 A
5,834,714 A * 11/1998 Berger et al. ..... 200/5 A
6,498,312 B1 * 12/2002 Villain ..... 200/510

FOREIGN PATENT DOCUMENTS

JP 11-96849 A 4/1999

* cited by examiner

*Primary Examiner* — Xuong Chung Trans
(74) *Attorney, Agent, or Firm* — Altis Law Group, Inc.

(57) ABSTRACT

A key structure used in a portable electronic device includes a resilient member forming a plurality of conducting films and a column, a dome member forming an arch portion and a peripheral portion, a circuit board forming a plurality of first terminals, second terminals and a third terminal. The dome member is mounted to the circuit board, the peripheral portion electronically connects to the second terminals, the resilient member covers the dome member, the conducting films conductively contact the first terminals. The resilient member is pressed to make the column resist against the arch portion, thereby the first terminals and the second terminals are both conductive, or the first terminals, the second terminals and the third terminal are all conductive.

7 Claims, 5 Drawing Sheets

KEY STRUCTURE

BACKGROUND

1. Technical Field

The present disclosure relates to key structures, particularly to a multi-contact key structure.

2. Description of Related Art

Portable electronic devices such as mobile phones and personal digital assistants (PDA) are widely used. Keys that can produce different results according to how they are pressed are herein called multi-contact keys. For example, a key or button of device that is pressed part way down to focus a camera then pressed all the way down to take a picture after focusing is done is one such multi-contact key.

However, the typical structure of the multi-contact key is complex and not easy to assemble.

Therefore, there is room for improvement within the art.

BRIEF DESCRIPTION OF THE DRAWINGS

Many aspects of the present key structure can be better understood with reference to the following drawings. The components in the various drawings are not necessarily drawn to scale, the emphasis instead being placed upon clearly illustrating the principles of the present battery cover mechanism. Moreover, in the drawings, like reference numerals designate corresponding parts throughout the diagrams.

DETAILED DESCRIPTION OF THE EMBODIMENT

Figure 1:
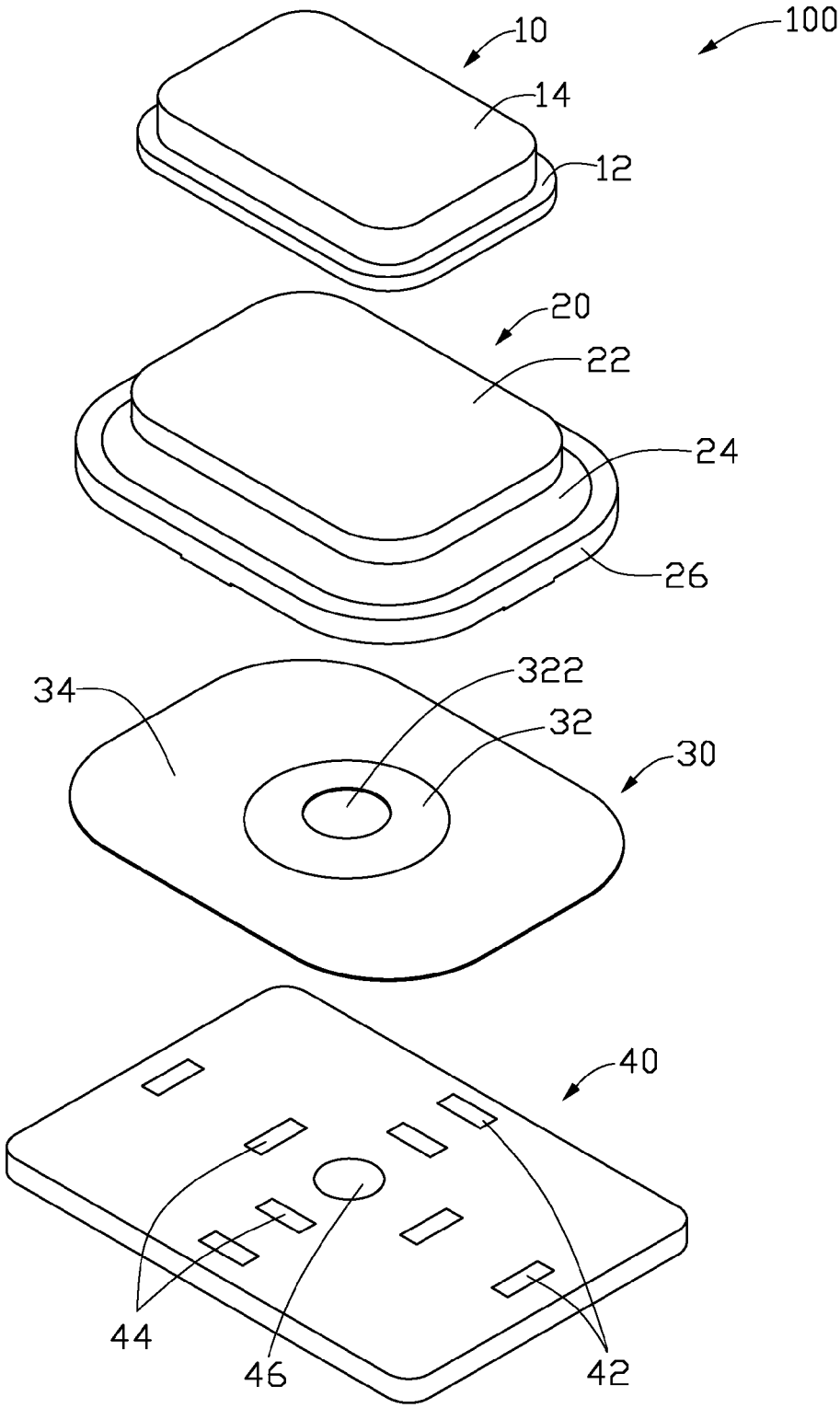
FIG. 1 is a disassembled view of the key structure, according to an exemplary embodiment.

FIG. 1 shows a key structure 100, which can be used in mobile phones and other portable electronic devices, such as personal digital assistants (PDAs), digital cameras, etc. The key structure 100 includes a pressing body 10, a resilient member 20, a dome member 30 and a circuit board 40. The pressing body 10 includes a base rim 12 and a protrusion 14 protruding from the base rim 12.

Figure 3:
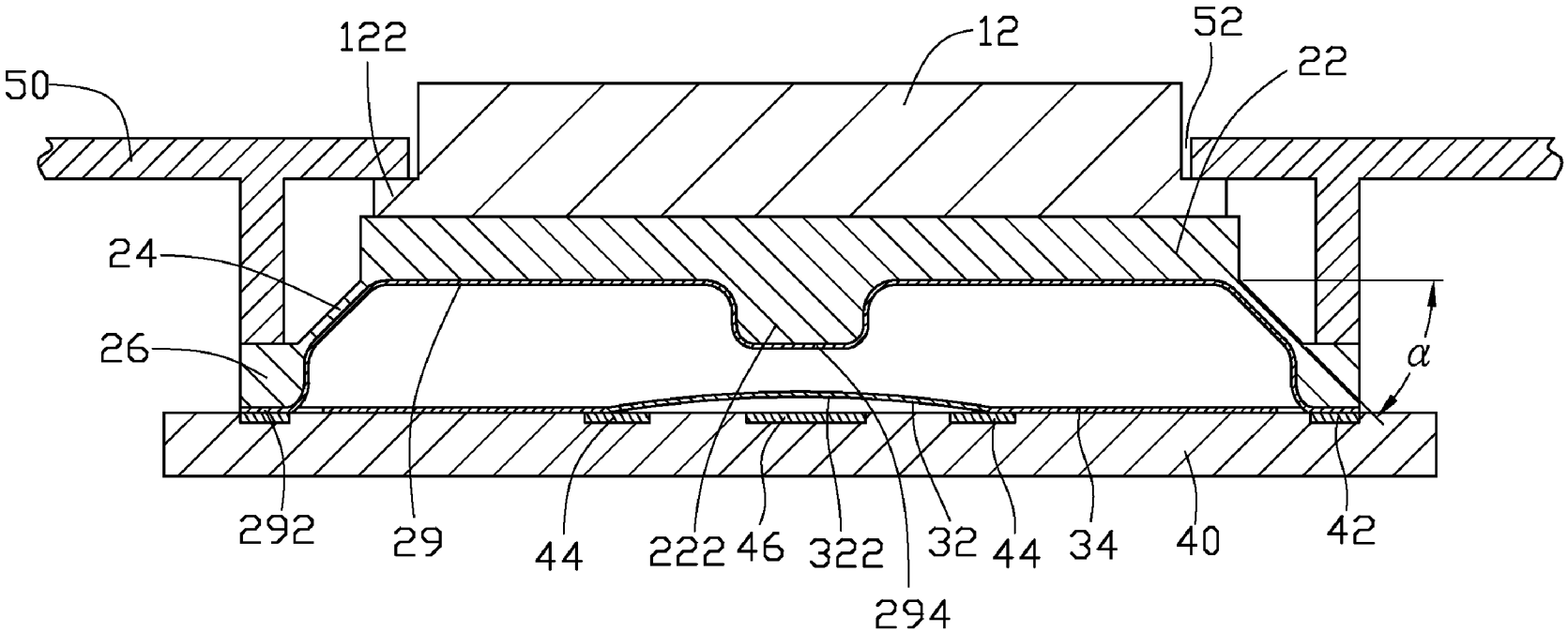
FIG. 3 is a section view of electronic device housing assembled the key structure shown in FIG. 1.

Referring further to FIG. 3, the resilient member 20 includes a cover board 22, a connecting wall 24 extending at a slant from the sidewall of the cover board 22, and a peripheral rim 26 connected to the bottom of the connecting wall 24 and substantially perpendicular to the cover board 22. The base rim 12 can receive the cover board 22 therein and engaged to each other using adhesive. The connecting wall 24 is thin and the slant relative to with the cover board 22 at an acute angle $\alpha$. The angle $\alpha$ can be about 40 to 50 degree.

Figure 2:
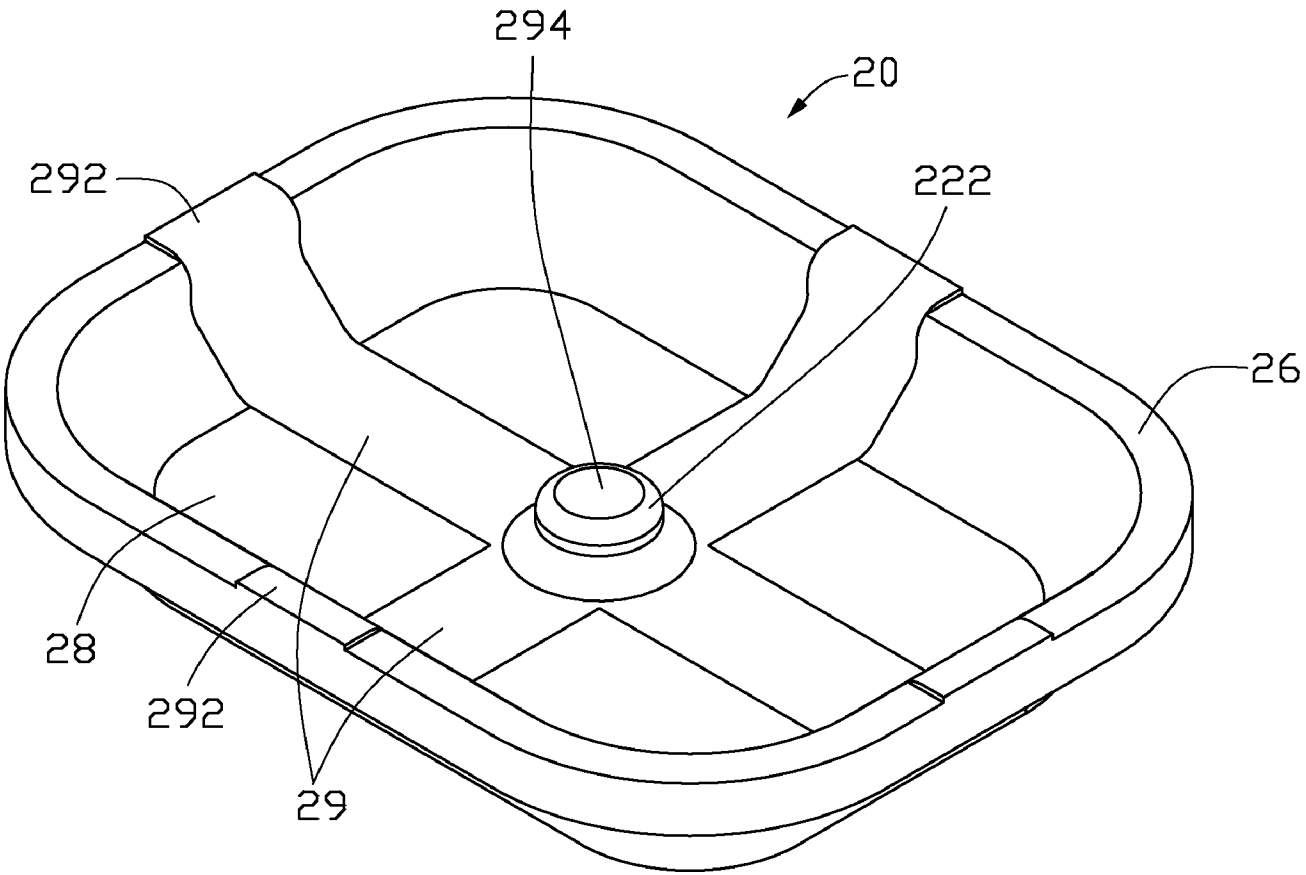
FIG. 2 is an assembled view of the resilient member of the key structure shown in FIG. 1.

Referring to FIG. 2, the cover board 22, the connecting wall 24 and the peripheral rim 26 enclose a chamber 28. The chamber 28 has a column 222 formed at the center of the bottom without extending out of the chamber 28. The bottom of the chamber 28 further has a plurality of conducting films 29 formed (e.g., printed or coated) thereon. The conducting films 29 are crossed and extend to the peripheral rim 26 to form a plurality of first connecting points 292. Four first connecting points 292 are located on the connecting sections of the conducting films 29 and the peripheral rim 26 in the present embodiment. The intersection of the conducting films 29 is located on the top of the column 222 and thus forms a second connecting point 294 thereon. The first connecting points 292 and the second connecting point 294 are configured for electronically connecting with the terminals of the circuit board 40.

The dome member 30 has an arch portion 32 formed at the center and a peripheral portion 34 around the arch portion 32. The arch portion 32 forms a touching point 322 at the center corresponding to the second connecting point 294 and configured for engaging with the second connecting point 294.

The circuit board 40 forms four first terminals 42, four second terminals 44 and a third terminal 46. The first terminals 42 correspond to the first connecting points 292 of the resilient member 20. The second terminals 44 are configured for electrically connecting to the peripheral portion 34. The third terminal 46 corresponds to the touching point 322 of the dome member 30.

Referring to FIG. 3, when the key structure 100 is assembled in the housing 50, the pressing body 10, resilient member 20, and the dome member 30 are positioned between the housing 50 and the circuit board 40. The dome member 30 is mounted to the circuit board 40, the peripheral portion 34 covers the first terminals 42, the second terminals 44 and the third terminal 46, and the peripheral portion 34 electronically connects with the second terminals 44. The touching point 322 of dome member 30 aligns with the third terminal 46. The resilient member 20 covers the dome member 30 and thus the dome member 30 is received in the chamber 28 of the resilient member 20. The peripheral rim 26 of the resilient member 20 abuts the periphery of the circuit board 40, the first connecting points 292 conductively contact the first terminals 42 of the circuit board 40 respectively, the second connecting point 294 of the column 222 aligns with the touching point 322. The pressing body 10 is attached to the resilient member 20, and the base rim 12 of the pressing body 10 resists the cover board 22 of the resilient member 20. The housing 50 defines an aperture 52, through which the protrusion 14 protrudes to outside, to facilitate pressing by a user of the protrusion 14 of the pressing body 10.

Figure 4:
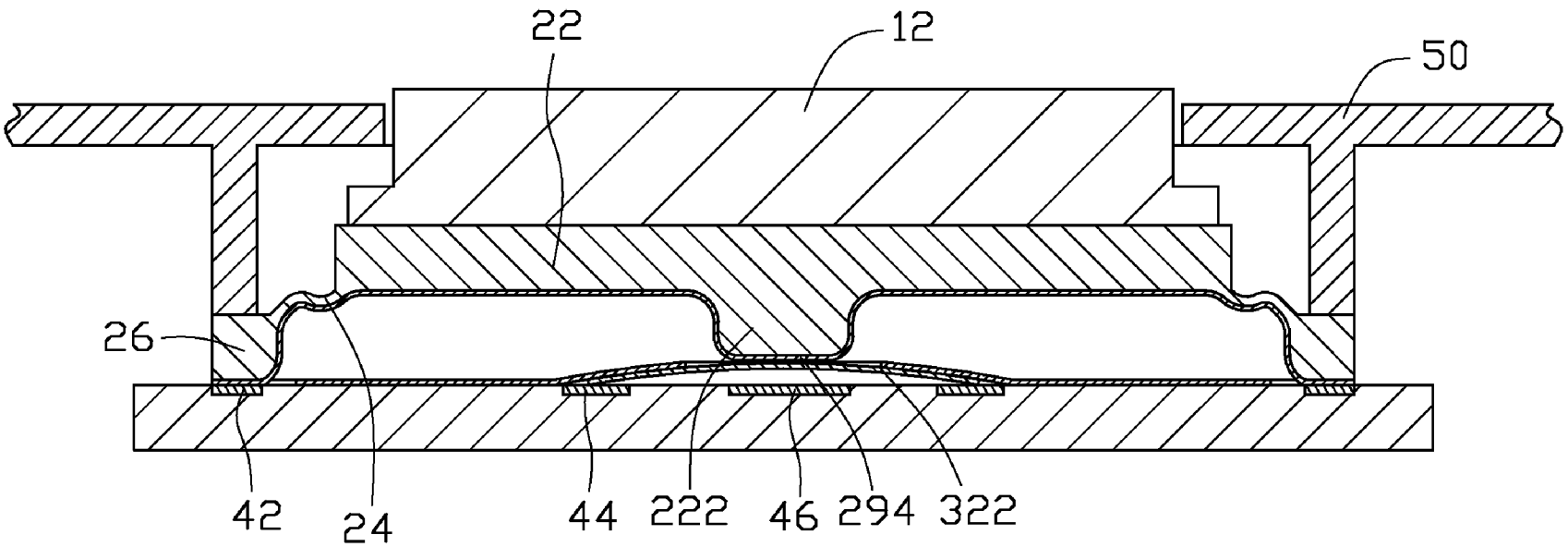
FIG. 4 is a section view of key structure shown in FIG. 1 in a first using state.
Figure 5:
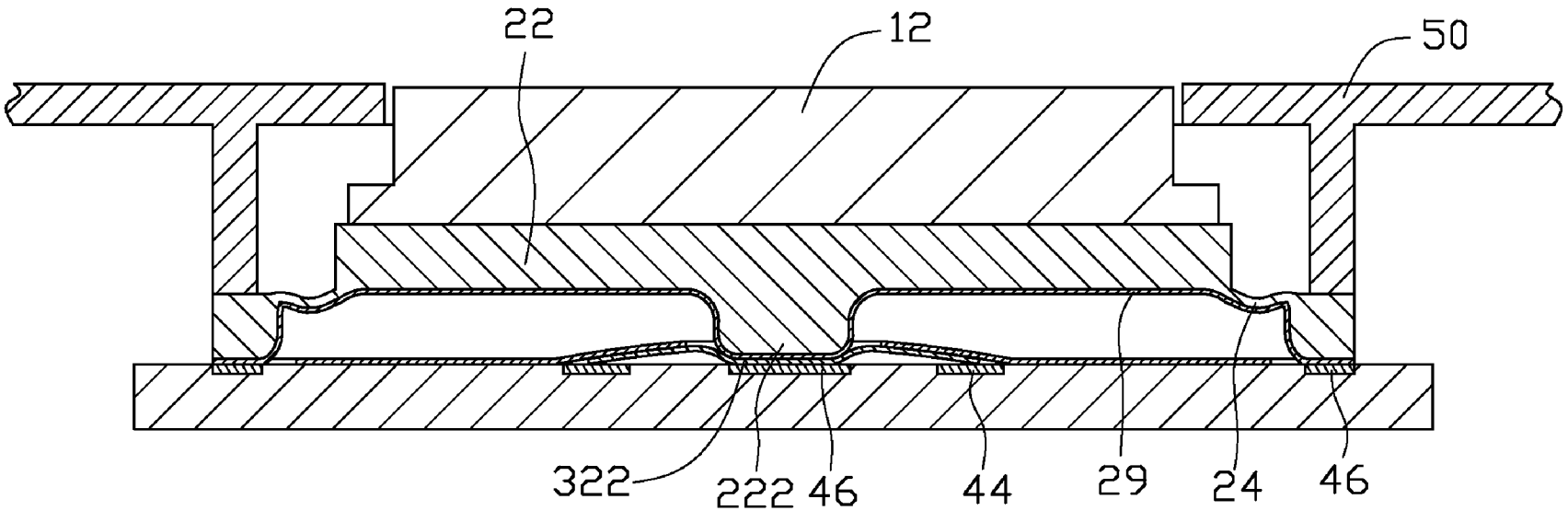
FIG. 5 is a section view of key structure shown in FIG. 1 in a second using state.

Referring to FIGS. 4 and 5, in use, the pressing body 10 is pressed, enabling the connecting wall 24 to be compressed. When the column 222 contacts and resists against the touching point 322, the second connecting point 294 electrically contacts the touching point 322. In this case, the conducting films 29 create an electrically conductive contact between the first terminals 42 and the second terminals 44, and the electronic device generates a first signal activating a first function mode. When the pressing body 10 is pressed to move further downwardly, the column 222 urges the touching point 322 downwardly until the touching point 322 resists against the third terminal 46. At this stage, the first terminals 42, the second terminals 44 and the third terminal 46 are all conductive. The electronic device generates a second signal activating a second function mode. When releasing the pressing body 10, the connecting wall 24 of the resilient member 20 restores to the original position by the releasing of the compressed force of the connecting wall 24.

It should be understood that the pressing body 10 can be omitted, and a pole of the cover board 22 arranged extending out from the aperture 52 of the housing 50.

It is to be understood that even though numerous characteristics and advantages of the present embodiments have been set forth in the foregoing description, together with details of structures and functions of various embodiments, the disclosure is illustrative only, and changes may be made in detail, especially in matters of shape, size, and arrangement of parts within the principles of the present invention to the full extent indicated by the broad general meaning of the terms in which the appended claims are expressed.

What is claimed is:

1. A key structure, comprising:

a resilient member comprising a cover board, a connecting wall and a peripheral rim, all of which being none-electrically-conducting, the connecting wall connecting the cover board to the peripheral rim, the connecting wall and the peripheral rim enclosing a chamber, the bottom of the chamber having a plurality of conducting films electrically formed thereon, the plurality of conducting films forming a plurality of first connecting points and a second connecting point electronically connecting with the first connecting points;

an electrically conducting dome member forming an arch portion and a peripheral portion around the arch portion;

a circuit board forming a plurality of first terminals corresponding to the first connecting points, second terminals corresponding to the peripheral portion of the dome member and a third terminal corresponding to the arch portion;

wherein the dome member is mounted to the circuit board, the peripheral portion electronically connects with the second terminals, the resilient member covers the circuit board to receive the dome member therein, the first connecting points electrically contact the first terminals, the second connecting point align with the arch portion of the dome member, when the resilient member is pressed towards the circuit board, the resilient member is partially deformed with the elastic deformation of the connecting wall, enabling the second connecting point to resist against the arch portion, wherein the first terminals and the second terminals are both electrically connected, further the first terminals, the second terminals and the third terminal are all electrically connected.

2. The key structure as claimed in claim 1, wherein the connecting wall extends at a slant from the sidewall of the cover board, the peripheral rim connected to the bottom of the connecting wall and substantially perpendicular to the cover board the cover board.

3. The key structure as claimed in claim 1, wherein the chamber forms a column therein, the conducting films extend to the peripheral rim to form the said first connecting points, the intersection of the conducting films is located on the top of the column and forms the said second connecting point.

4. The key structure as claimed in claim 1, wherein the connecting wall is slanted relative to with the cover board at an angle, the angle is in the range of about 40-50 degree.

5. The key structure as claimed in claim 1, wherein the key structure includes a pressing body, the pressing body is mounted to the resilient member to easy pressing of the key structure by a user.

6. The key structure as claimed in claim 5, wherein the key structure includes a housing, the hosing defines an aperture, the pressing body, the resilient member, the dome member are positioned between the housing and the circuit board, the pressing body protrudes through the aperture to outside.

7. The key structure as claimed in claim 1, wherein the arch portion is formed at the center of the dome member and the peripheral portion is formed around the arch portion, the arch portion forms a touching point, the touching point is configured for engaging with the second connecting point.

* * * * *